United States Patent [19]

Sartran

[11] Patent Number: 4,463,889

[45] Date of Patent: Aug. 7, 1984

[54] SPECIAL SCREW FEED MECHANISM FOR SCREWS, BOLTS, RIVETS, NAILS, ETC.

[75] Inventor: Bernard C. Sartran, Filderstadt, Fed. Rep. of Germany

[73] Assignee: The Aro Corporation, Bryan, Ohio

[21] Appl. No.: 361,725

[22] Filed: Mar. 25, 1982

[30] Foreign Application Priority Data

Mar. 30, 1981 [DE] Fed. Rep. of Germany ..... 3112520

[51] Int. Cl.[3] ..... B25C 3/00

[52] U.S. Cl. ..... 227/112; 221/233; 227/117; 227/118

[58] Field of Search ..... 227/112, 117, 118, 120, 227/130; 221/233, 234, 235

[56] References Cited

U.S. PATENT DOCUMENTS

| | | | |
|---|---|---|---|
| 1,753,499 | 4/1930 | Burger | 227/118 |
| 2,506,994 | 5/1950 | Chadwick | 227/112 X |
| 2,510,137 | 6/1950 | Post | 227/118 |
| 3,802,617 | 4/1974 | Berecz | 227/112 |
| 4,008,842 | 2/1977 | Wilson et al. | 227/117 |

FOREIGN PATENT DOCUMENTS

| | | | |
|---|---|---|---|
| 2236696 | 10/1974 | Fed. Rep. of Germany . | |
| 677867 | 8/1979 | U.S.S.R. | 221/233 |

*Primary Examiner*—Paul A. Bell

*Attorney, Agent, or Firm*—Allegretti, Newitt, Witcoff & McAndrews, Ltd.

[57] ABSTRACT

A screw feed mechanism includes a pivoting magazine positioned in a housing. The magazine includes a single throughbore which receives a single screw from a feeder hose and then pivots into alignment with a drive tool. The magazine is driven by a pneumatic cylinder.

8 Claims, 2 Drawing Figures

SPECIAL SCREW FEED MECHANISM FOR SCREWS, BOLTS, RIVETS, NAILS, ETC.

BACKGROUND OF THE INVENTION

The invention relates to a special mechanism for feeding screws, bolts, rivets, nails, etc. into position for driving by an axially moving tool aligned with a collet. A side-merging feeder hose is connected to a pivoting magazine. Screws, bolts, etc. are individually fed into the magazine which is then pivoted for driving the screw by the tool.

German patent specification No. DE-PS 2236696 discloses a screw feed mechanism in which screws, bolts, etc. that feed into the mechanism may tip or jam in the feeder hose or may feed at an undesired angle. Particularly when feeding short screws etc., or screws or rivets with large heads, production disturbances may occur. When the mechanism will not function in the desired manner, automatic production is not possible. Although the referenced German specification teaches an improved installation mechanism for installing relatively short articles without interruption, the present invention comprises a further improvement.

SUMMARY OF THE INVENTION

Thus, the present invention comprises a mechanism for overcoming the problems associated with prior screw feed mechanisms, and includes an insert or magazine at the intersection of a tool passage, collet passage and the fastener feeding hose. The magazine swings or pivots between axial alignment with the feeder hose and axial alignment with the tool passage so as to align the magazine in a screw feed position or a screw application position. Consequently, a fastener, such as a screw, bolt, etc. can be positioned for driving by the tool and then directed by the axially moving tool to its point of installation. Installation by the tool is affected as the tool axially projects through the magazine without jamming or tipping the fastener.

To stop the flow of individually fed fasteners or objects such as screws, bolts, etc., the magazine can be pivoted to a position which blocks the feeder hose. The magazine can be easily removed and easily replaced. Further, an additional surface can be defined by the side of magazine to block the intake position of feeder hose. Thus, while one object or fastener is being installed by a tool projecting through the magazine, a second fastener can simultaneously be positioned adjacent the magazine. In this manner, fasteners can be fed into fastening position in very short time intervals. The magazine position and movement can be controlled by electro-magnetic or pnematic controls and circuitry.

The control mechanism can terminate the axial movement of the tool in the magazine to prevent damage to the housing and the magazine.

The magazine in the housing can be mounted for rotation in response to a spring drive. The spring is preferably mounted on a split pin that supports the magazine and defines a pivot axis about which the spring pivots the magazine between a fastener feed and a fastener attachment position. Magazines of various sizes for variously sized screws can easily be exchanged and a spare magazine may be stored in a storage chamber provided in the housing.

A pneumatic, actuated piston may be used to drive the magazine against the force of a spring to move the magazine from the fastener feed to the fastener attachment position.

A compact embodiment of the mechanism includes a magazine which is driven in opposite rotational senses by an attached piston rod driven by an air cylinder. Also, an air cylinder can be mounted in a drilled hole in the housing to drive the magazine.

These and other objects, advantages and features of the invention will be set forth in the detailed description which follows.

BRIEF DESCRIPTION OF THE DRAWING

Additional information can be obtained from the following drawings.

DESCRIPTION OF THE PREFERRED EMBODIMENT

In the figures, like numbers designate like parts.

Figure 1:
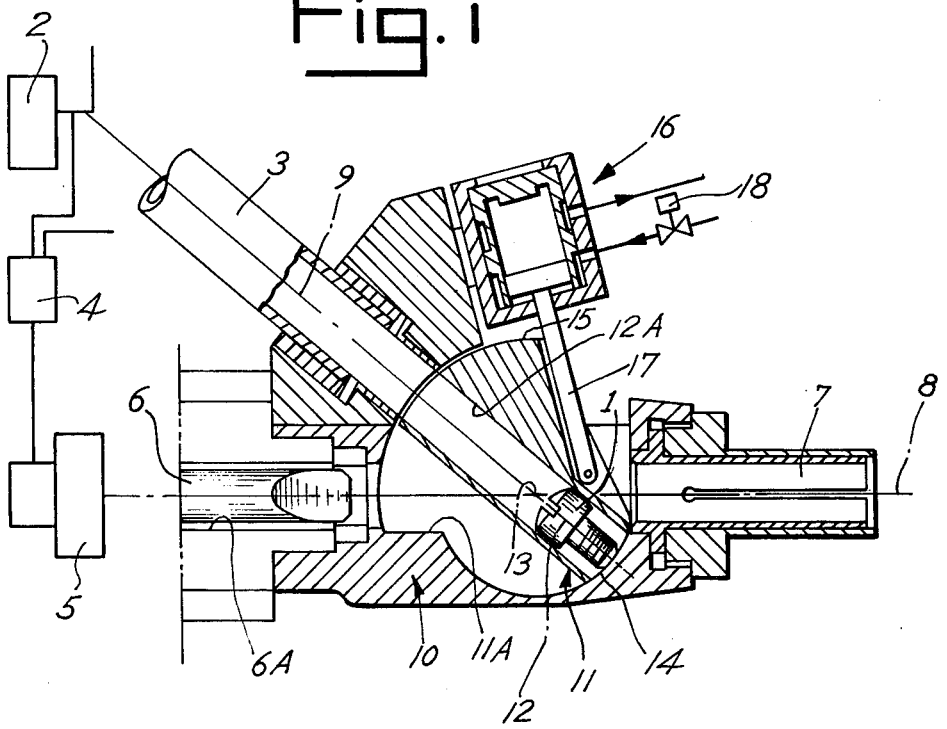
FIG. 1 is a side cross sectional view of a first embodiment.

Referring to FIG. 1, a screw feed apparatus includes a reservoir 2 for fasteners such as screws 1 or other objects. Reservoir 2 is connected to a mechanism for separating a fastener from those in the reservoir and for orienting the fastener, then directing the fastener to the attachment mechanism by a feeder hose 3. The mechanism for separating (not shown) is operated and controlled by a control device 4. A tool advance mechanism 5 for a tool or bit 6 is also controlled by control device 4.

Thus, bit 6 moves axially along axis 8 into a collet 7. Bit 6 and collet 7 are axially aligned whereas the feeder hose 3 defines an axis 9 at an angle with respect to axis 8. Axis 9 intersects axis 8.

A housing 10 defines a channel or passage 6A for the tool 6 and also supports the collet 7 in axial alignment with tool 6. A magazine 11 is pivotally or rotatably mounted in a chamber or recess 11A in housing 10. Magazine 11 includes a throughbore or channel 12A having an axis 12. The channel 12A receives a fastener 1 from feeder hose 3. The magazine 11 may be pivoted about axis or pivot point 13 which is at the intersection of axis 8 and axis 9 so as to align axis 12 with feeder axis 9 as shown in FIG. 1 or tool insert axis 8. The movement of magazine 11 is guided by the recess or chamber walls 11A in housing 10.

In the illustrated feeder position for magazine 11 of FIG. 1, the screw 1 is fed into channel associated with axis 12 and is stopped and retained by a stop wall 14 in the housing 10. Then the magazine 11 is pivoted about axis 13 to align the axis 12 with axis 8. The tool 6 is inserted into the passage or channel on axis 12 in the magazine 11 to engage and advance the screw 1 into collet 7 and thence into a fixture. In this manner the screw 1 is installed, screwed, etc. During this process as screw 1 is driven by bit 6, the next screw 1 can be advanced through feeder hose 3 up to retaining wall 15 of magazine 11 which is opposed to the feeder hose 3 on the axis 9. The magazine 11 is pivoted by actuation of an air cylinder 16 mounted on housing 10. Cylinder 16 has a piston rod 17 coupled to the magazine 11. The air cylinder 16 can be opened or closed by air pressure controlled by a control valve 18 in response to control signals from control device 4.

Figure 2:
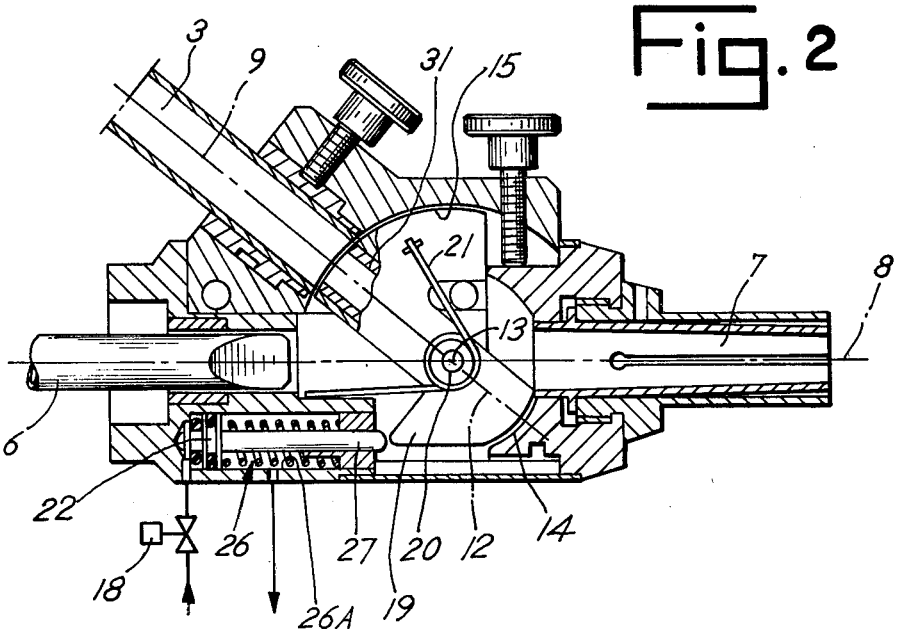
FIG. 2 is a side cross sectional view of a second embodiment.

In the embodiment of FIG. 2, an air cylinder 26 is positioned in an opening 26A in the housing 10 parallel to direction of axis 8 in the housing 10. A piston rod 27 projects against a lever arm 19 of a magazine 31. The magazine 13 itself is located in the housing 10 on a split mounting shaft or pin 20 which is transverse to axes 8 and 9 on pivot axis 13. Mounted on the split pin 20 is a spring 21 which holds or biases the magazine 31 in the screw feed position aligned with axis 9.

The magazine 31, the feeder hose 3 and the collet 7 are mounted in housing 10 and are easily exchangeable to accommodate different sizes of screws, etc. Nails, screws, bolts, etc. are transported through magazines 11 or 31 into a proper position with respect to the collet 7 so that with short objects especially, such as screws, bolts, etc., no jamming occurs. To save space and weight, a piston 22 for air cylinder 26 can be mounted in a variety of positions including the position illustrated in FIG. 2.

Thus, while preferred embodiments of the invention have been disclosed, the invention is to be limited by the following claims and their equivalents.

What is claimed is:

1. An improved screw feed mechanism comprising, in combination:

a housing having a throughbore defining a tool axis, a magazine chamber on the axis separating the throughbore into a tool bore and a collet bore;

a tool in the tool bore translatable along the axis through the region of the chamber;

fastener supply means;

a fastener magazine in the chamber, said magazine including a throughbore for receipt of a fastener, said magazine mounted in the chamber for pivotal movement about an axis transverse to the tool axis on a pivot substantially intersecting the tool axis between a first position aligning the magazine throughbore with the tool axis and a second position for receipt of a fastener from the fastener supply means; and pneumatic means for pivoting and aligning the magazine in at least one of the positions.

2. The mechanism of claim 1 including a fastener feeder passage aligned with the fastener magazine in the second position.

3. The mechanism of claim 2 wherein the axes of the tool bore and the feeder passage and of rotation of the magazine all intersect at a common point.

4. The mechanism of claim 2 wherein the magazine blocks the fastener feeder passage except in the second position.

5. The mechanism of claim 1 including a pneumatic drive means attached to the magazine for pivoting the magazine between the first and second position.

6. The mechanism of claim 1 wherein the magazine blocks the tool bore except when in the first position.

7. The mechanism of claim 1 including mechanical biasing means for biasing magazine to one of the positions.

8. The mechanism of claim 7 including a pneumatic drive connected to the magazine for pivoting the magazine against the biasing force of the biasing means.

* * * * *